US007108670B2

(12) United States Patent
Huang

(10) Patent No.: US 7,108,670 B2
(45) Date of Patent: Sep. 19, 2006

(54) LIMB MASSAGER

(76) Inventor: Chien-Ming Huang, 11-1 Fl., No. 23, Sec. 2, Keelung Road, Taipei (TW)

( * ) Notice: Subject to any disclaimer, the term of this patent is extended or adjusted under 35 U.S.C. 154(b) by 50 days.

(21) Appl. No.: 10/954,689

(22) Filed: Sep. 29, 2004

(65) Prior Publication Data

US 2006/0069332 A1 Mar. 30, 2006

(51) Int. Cl.
*A61H 7/00* (2006.01)

(52) U.S. Cl. ..... 601/94; 601/90; 601/93; 601/134

(58) Field of Classification Search ..... 601/84, 601/86, 87, 89.9, 93–95, 97, 98, 100, 101, 601/103, 104, 107, 108, 111, 112, 116, 126, 601/133, 134
See application file for complete search history.

(56) References Cited

U.S. PATENT DOCUMENTS 6,599,261 B1 * 7/2003 Chen ..... 601/115
6,629,940 B1 * 10/2003 Shimizu ..... 601/133
6,837,861 B1 * 1/2005 Lin ..... 601/87

* cited by examiner

*Primary Examiner*—Quang D. Thanh
(74) *Attorney, Agent, or Firm*—Dellett & Walters

(57) ABSTRACT

A massager has a base, a motor assembly mounted on the base and having a worm shaft extending out of the motor, a transmission assembly including a transmission axle, a linking gear to mate with the worm gear, two secondary gears to drive two horizontal gears of a rubbing assembly and two pairs of kneading assemblies being respectively provided on opposite sides of the central seat to wabble when the transmission axle is rotated. Therefore, rotation of the rubbing assembly and wobbling movement of the kneading assembly are able to provide two different massaging effects to the user.

4 Claims, 8 Drawing Sheets

LIMB MASSAGER

BACKGROUND OF THE INVENTION

1. Field of the Invention

The present invention relates to a limb massager, and more particularly to a multiple-function limb massager having two pairs of kneading plates respectively and eccentrically mounted on a transmission axle and two pairs of rubbing disks driven by the transmission axle and located between one pair of kneading plates such that the user is able to extend any one of the limbs into an area enclosed by a pair of kneading plates and a pair of rubbing disks to enjoy both kneading and rubbing effects of the massager of the present invention.

2. Description of Related Art

A conventional massager comprises a motor, a pair of linkages and a pair of massage balls. The linkages are eccentrically connected to opposite ends of the motor shaft. Each of the massage balls is securely engaged with a corresponding one of the linkages. Because the linkages are eccentrically engaged with the motor shaft, the motor will thus drive and move the linkages. That is, the rotational movement of the motor shaft will be transformed into reciprocating movement of the linkage. Accordingly, the massage balls securely mounted on the linkages will move up and down. When the massager is put against the user's skin, the up and down movement of the balls generates a massage effect to the user.

However, the massaging effect generated by the monotonous up and down movement of the balls can only be applied to a single limited area. When the user wants to apply the massager to a nearby area, the user will have to move the massager of this kind to the designated nearby area. Therefore, not only is the massage effect not as good as expected, but also using this massager is troublesome.

To overcome the shortcomings, the present invention tends to provide an improved multiple-function massager to mitigate and obviate the aforementioned problems.

SUMMARY OF THE INVENTION

The primary objective of the present invention is to provide a massager that has two pairs of kneading plates and two pairs of rubbing disks. The kneading plates are eccentrically mounted on a transmission axle which is in connection with a worm shaft and the rubbing disks are driven by the transmission axle. Therefore, the user is able to enjoy two different massaging effects.

Other objects, advantages and novel features of the invention will become more apparent from the following detailed description when taken in conjunction with the accompanying drawings.

DETAILED DESCRIPTION OF PREFERRED EMBODIMENT

Figure 1:
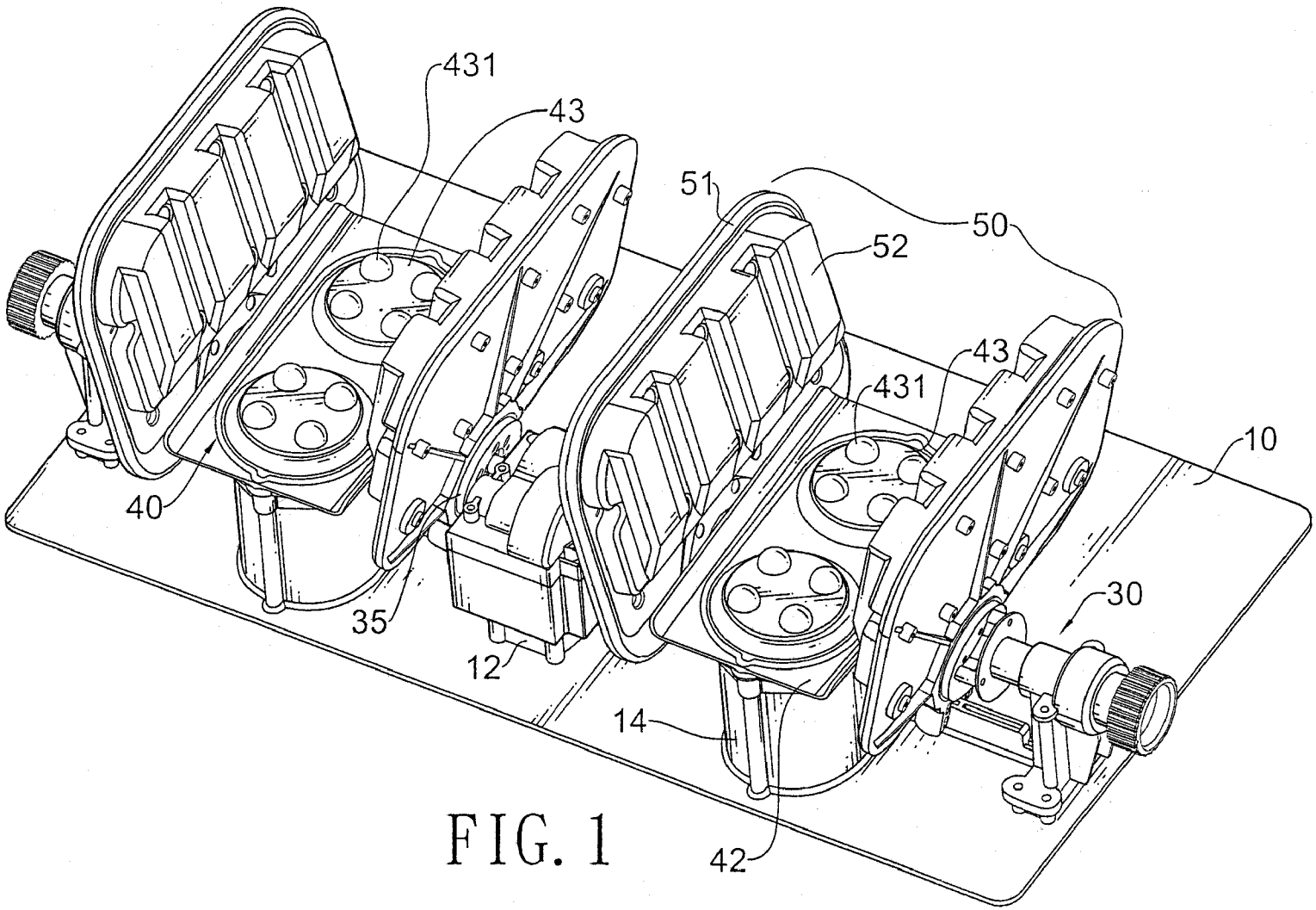
FIG. 1 is a perspective view showing the appearance of the massager of the present invention.
Figure 2:
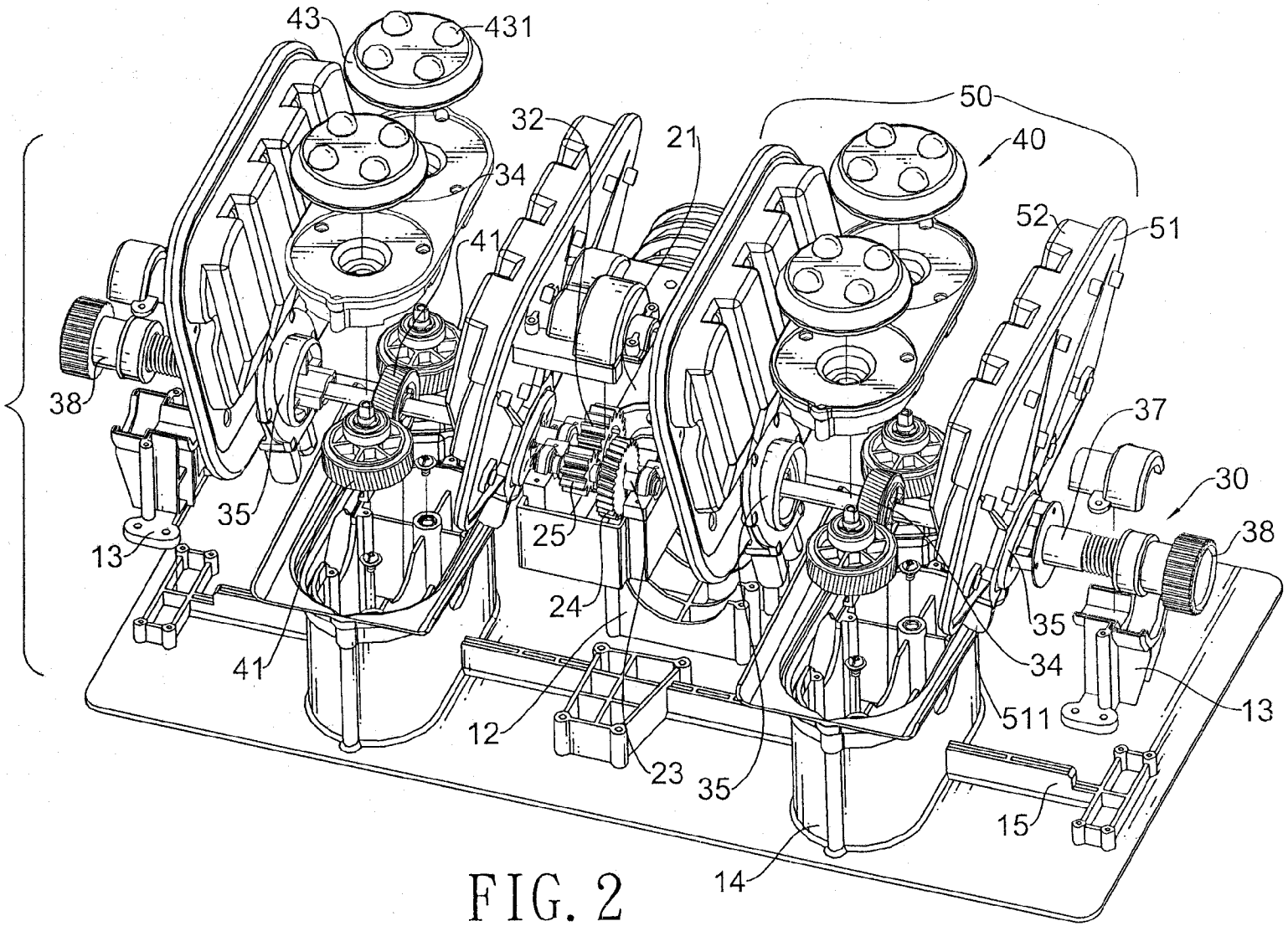
FIG. 2 is a partially exploded perspective view of the massager in FIG. 1.
Figure 3:
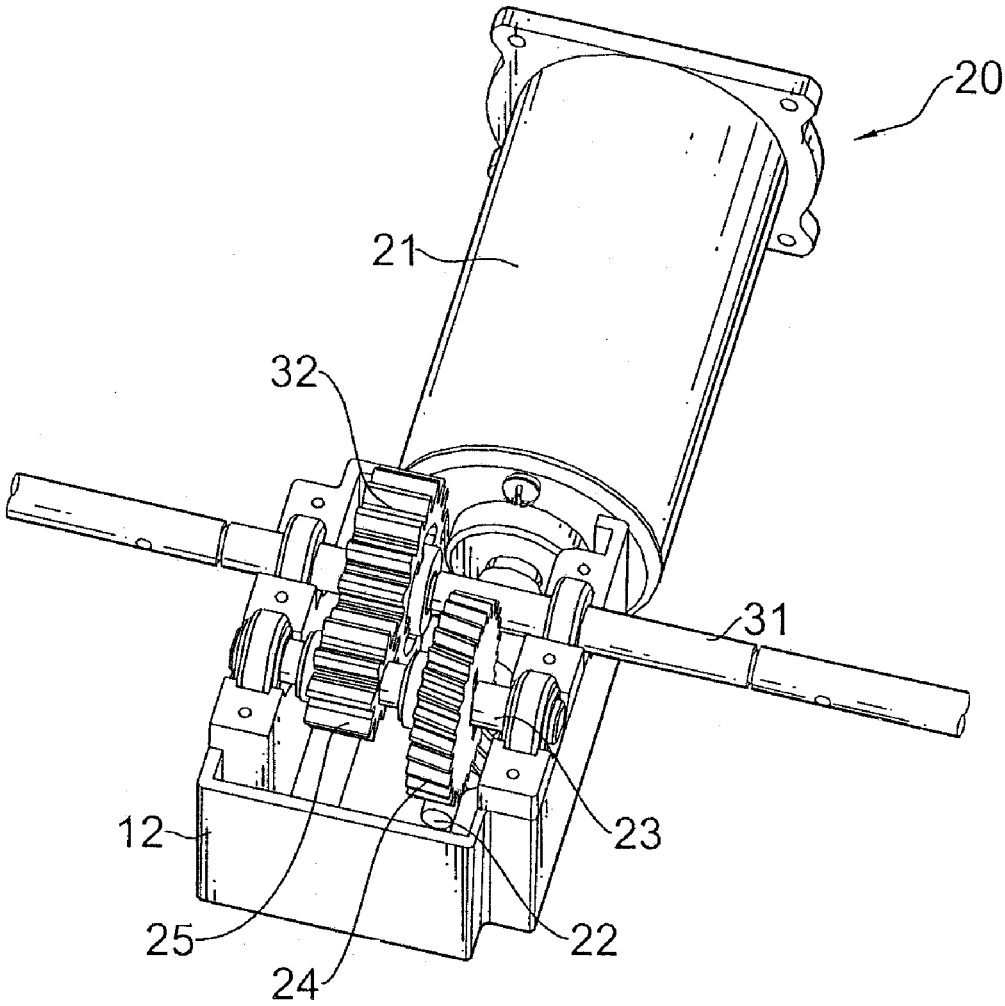
FIG. 3 is a perspective view showing the motor and the transmission axle of the present invention.

With reference to FIGS. 1, 2 and 3, the massager in accordance with the present invention has a base (10) with a central seat (12) integrally formed on a central area of the housing (10), two side seats (13) respectively mounted on opposed sides of the central seat (12), two mediate seats (14) respectively sandwiched between the central seat (12) and the side seat (13) and a guiding rib (15) integrally formed on a top face of the base (10). The central seat (12) is hollow to receive therein a motor assembly (20) which has a worm shaft (22) extending out of a motor (21), a linkage (23) mounted across the central seat (12) and provided with a worm gear (24) fixedly mounted around the linkage (23) to mate with the worm shaft (22) and a driving gear (25) also fixedly mounted around the linkage (23). A transmission assembly (30) includes a transmission axle (31) having two ends to be respectively received in the two side seats (13), a linking gear (32) fixedly mounted around the transmission axle (31) to mate with the driving gear (25) of the motor assembly (20), two secondary linking gears (34) respectively mounted on the transmission axle (31) and being divided by the central seat (12), two pairs of wobbling wheels (35) respectively mounted on the transmission axle (31) to be opposite to one another to sandwich therebetween one secondary linking gear (34) and divided by the mediate seat (14), two annular sleeves (37) each corresponding to one of the wobbling wheels (35) to be slidably mounted on the transmission axle (31) and two control knobs (38) respectively and threadingly connected to two ends of the transmission axle (31) to abut a peripheral edge of a corresponding one of the two annular sleeves (37) such that rotation of each control knob (38) is able to control the position of the respective wobbling wheel (35).

Two pairs of rubbing assemblies (40) are provided to opposed sides of the central seat (12) and each rubbing assembly (40) includes two horizontal gears (41) respectively mated with the secondary linking gear (34) on opposite directions of the secondary linking gear (34) and received in the mediate seat (14), two rubbing disks (43) respectively mounted on top of a corresponding one of the two horizontal gears (41) to be driven by the horizontal gears (41) and each having multiple bosses (431) formed on a top face of the rubbing disk (43).

Two pairs of kneading assemblies (50) are provided to opposed sides of the central seat (12) and each kneading assembly (50) includes two kneading plates (51) each mounted on a corresponding one of the two wobbling wheels (35) and having a kneading pad (52) mounted on the kneading plate (51) and two extensions (511) extending downward from a bottom of the kneading plate (51) so that the guiding rib (15) is able to be received between the two extensions (511) to limit movement of the kneading plates (51).

Figure 4:
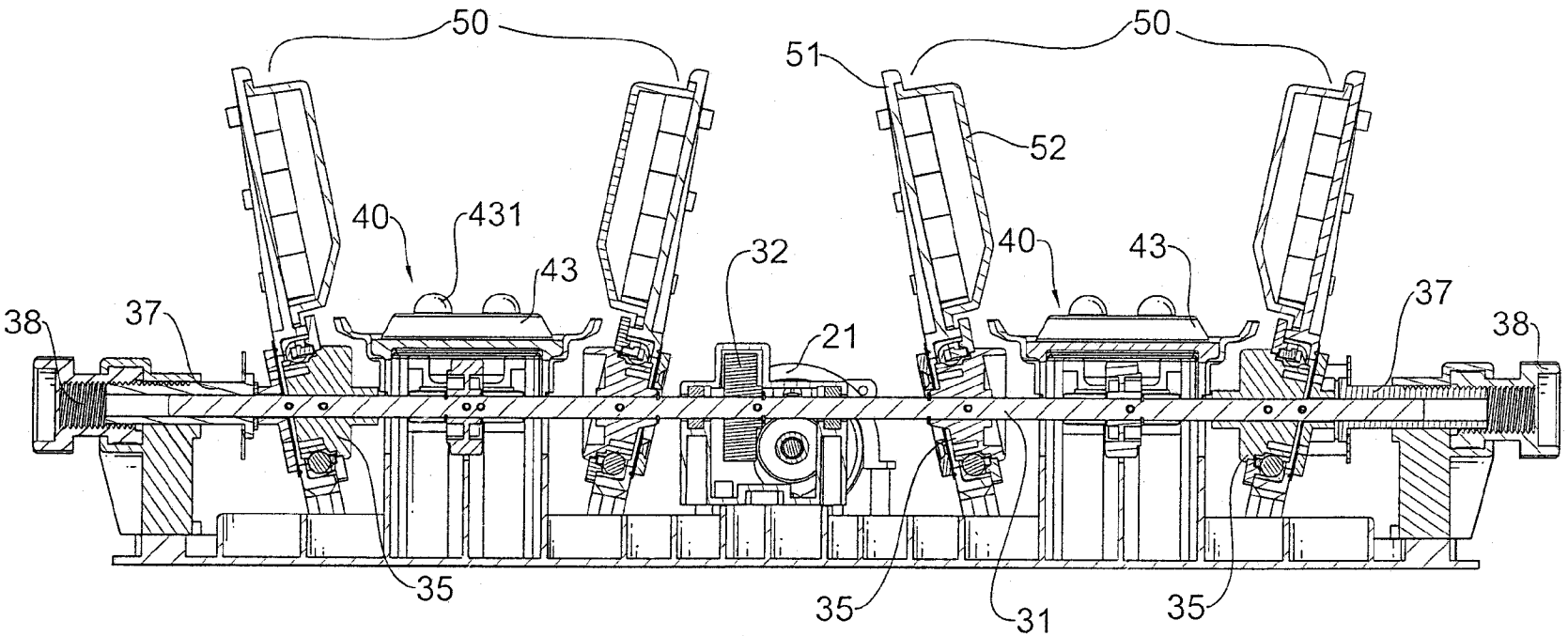
FIG. 4 is a side plan view in cross section showing the connection between the kneading plates and the rubbing disks.
Figure 5:
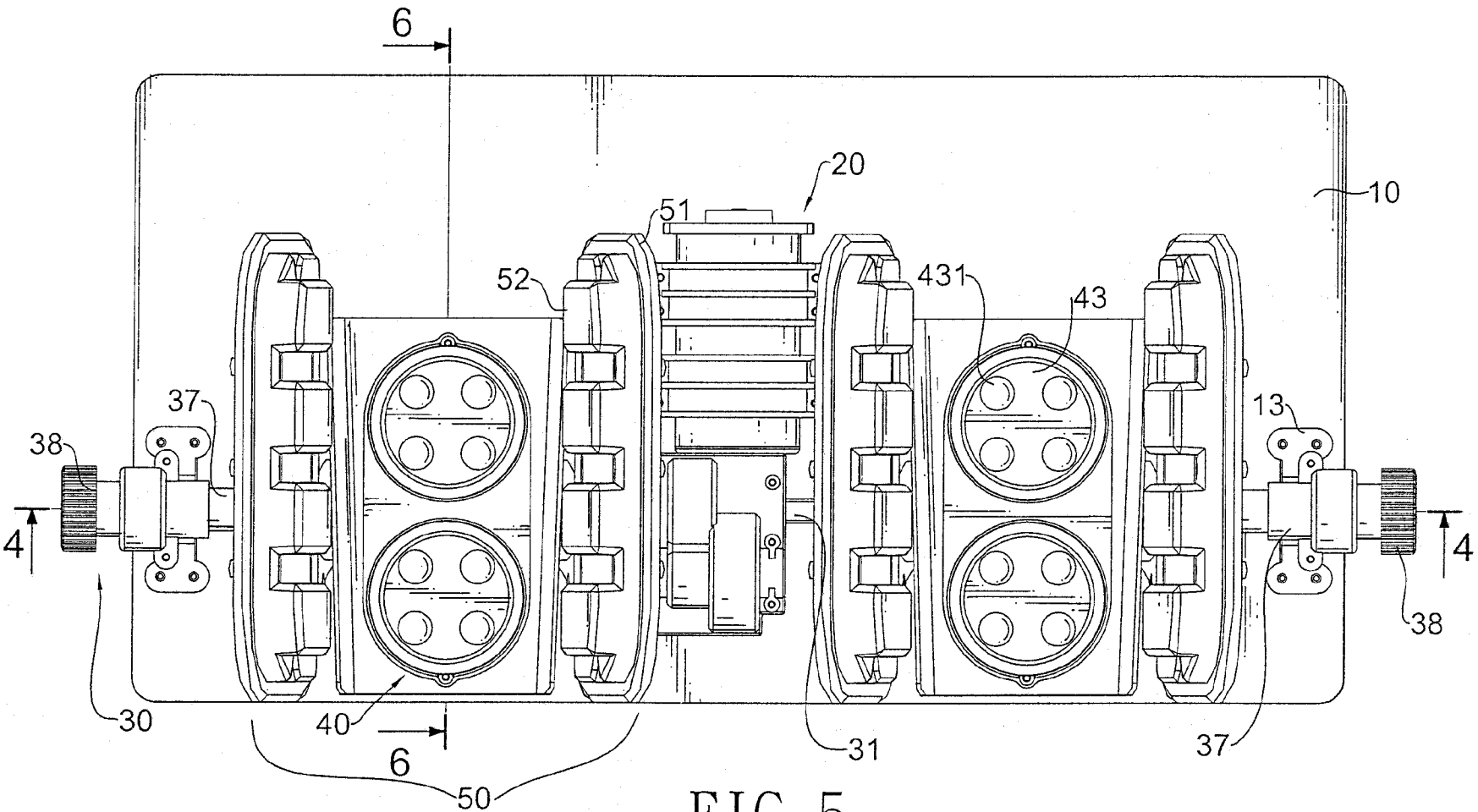
FIG. 5 is a top plan view of the massager of the present invention.

With reference to FIGS. 4 and 5 and still using FIGS. 2 and 3 for reference, when the massager of the present invention is assembled, it is noted that the motor (21), the worm shaft (22), the linkage (23), the worm gear (24), the driving gear (25) and the linking gear (32) are received in the central seat (12), as shown in FIG. 3. Furthermore, after the transmission axle (31) is extended through the wobbling wheels (35) and the secondary linking gears (34), one of the annular sleeves (37) is mounted around the transmission axle (31) to abut the outer periphery of the wobbling wheel (35) and then the two control knobs (38) are mounted to two ends of the transmission axle (31). Thereafter, each pair of kneading plates (51) is mounted on the two wobbling wheels (35) to enable the kneading plates (51) to wabble. The reason for the kneading plates (51) being able to wabble is that each of the wobbling wheels (35) is provided with a wobbling sleeve which is eccentrically connected to the wobbling wheel (35) such that when the wobbling wheel (35) is rotated, the wobbling sleeve is rotatably wobbled relative to the wobbling wheel (35). Further, because the eccentric connection between wobbling sleeve and the wobbling wheel is conventional in the art, detailed description thereof is omitted for brevity.

Still, when the secondary linking gear (34) is rotated due to the rotation of the transmission axle (31) resulting from the activation of the motor (21), the two horizontal gears (41) are rotated such that the rubbing disks (43) mounted on top of the two horizontal gears (41) are also rotated.

Figure 6:
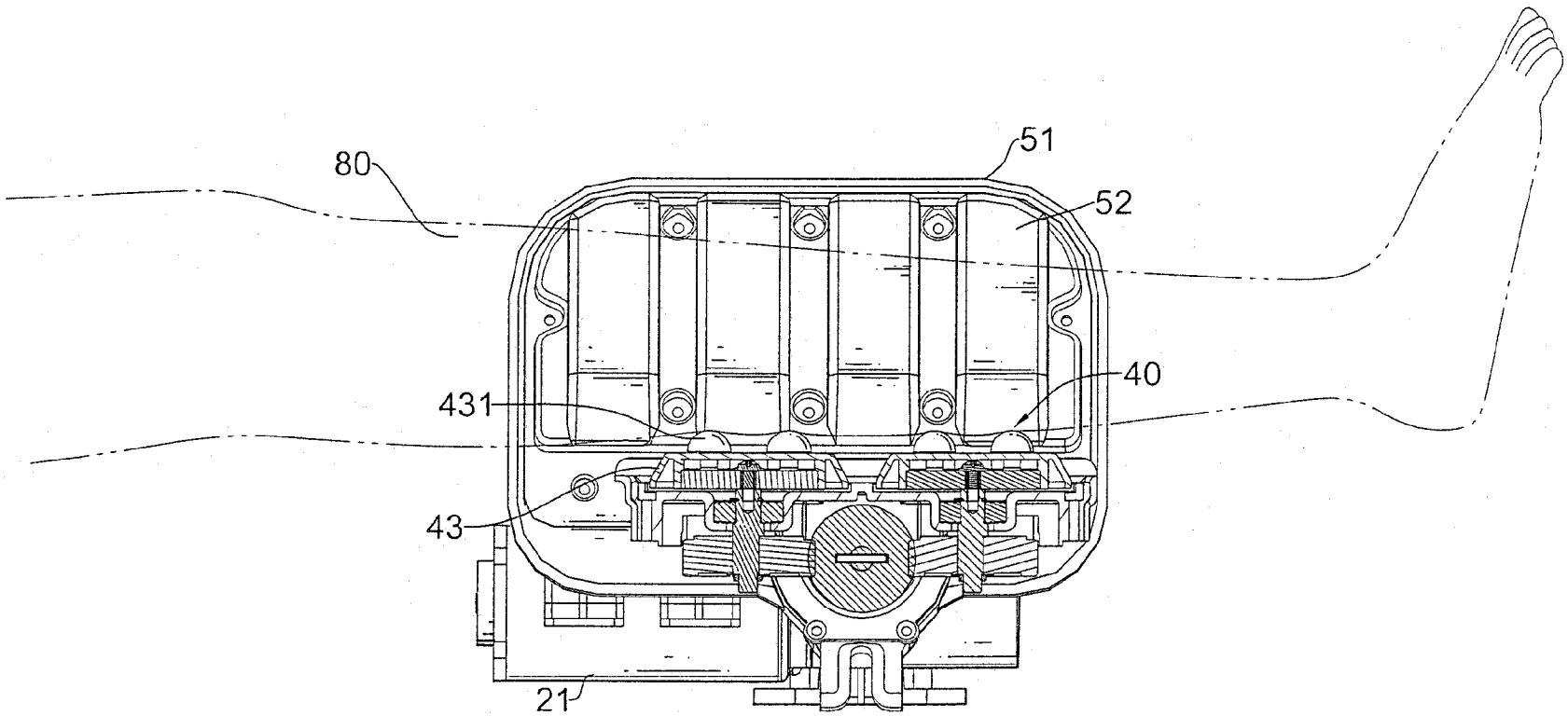
FIG. 6 is an operational side plate view in cross section showing that a leg is extended through a pair of kneading plates and a pair of rubbing disks.
Figure 7:
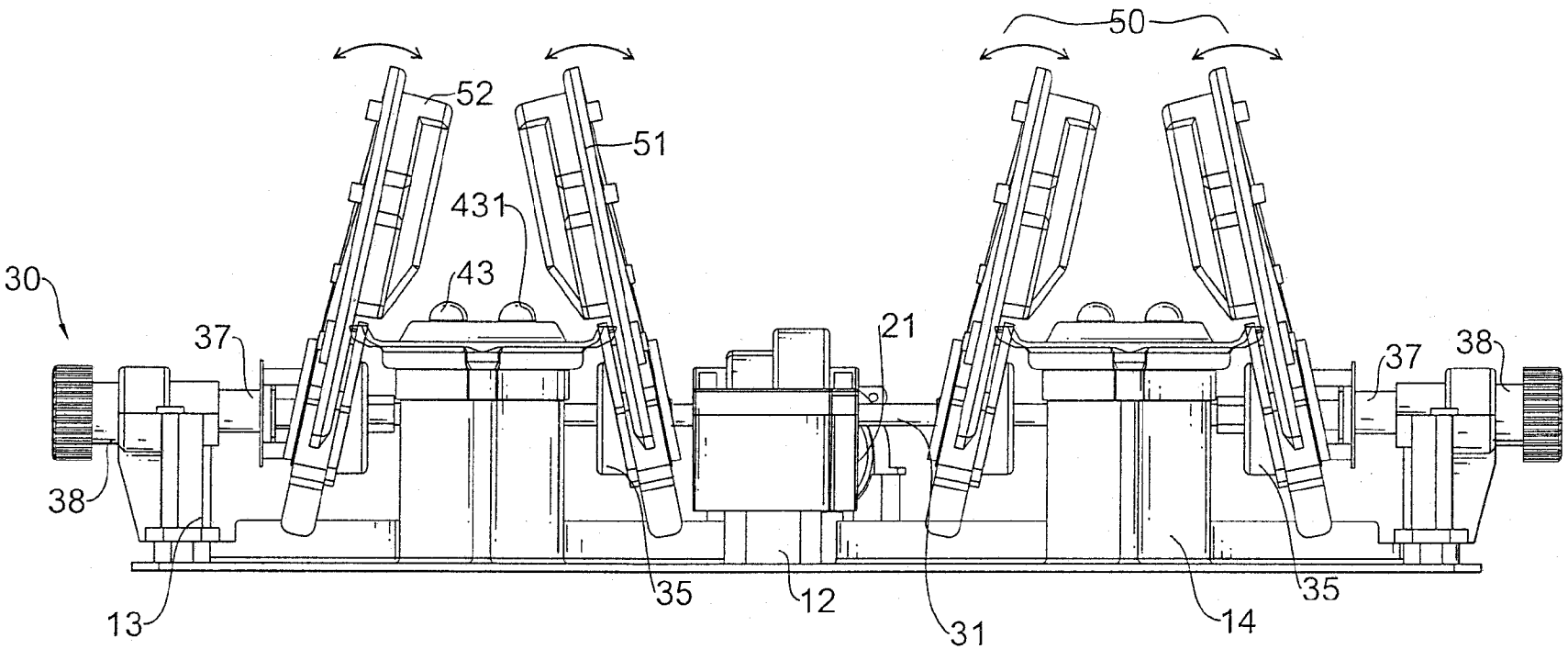
FIGS. 7 and 8 are schematic views showing the operation of the kneading plates and the rubbing disks of the present invention.
Figure 8:
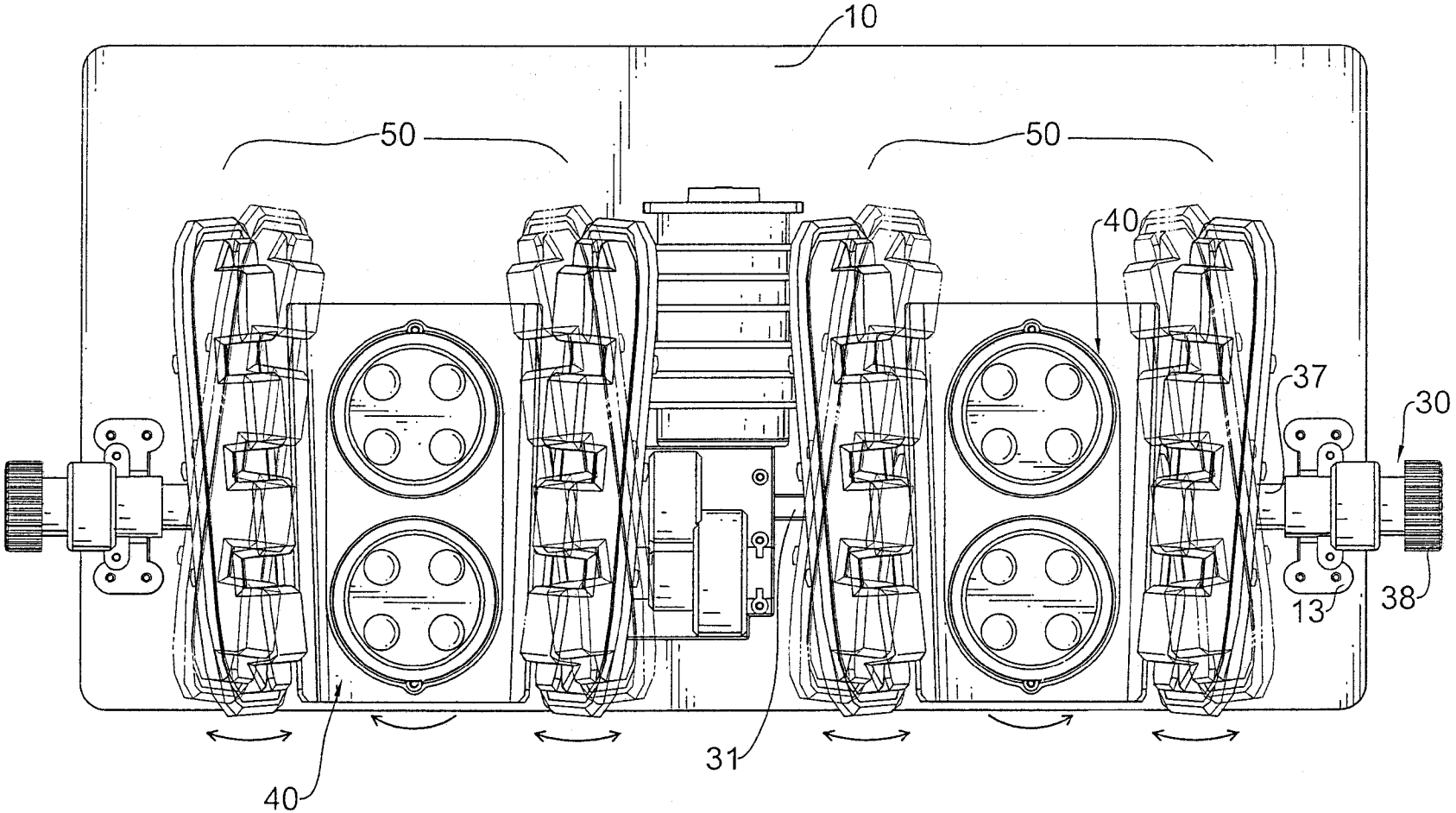

Therefore, with reference to FIGS. 6, 7 and 8, when the user extends a limb into an area enclosed by two kneading plates (51) and two rubbing disks (43), the wobbling effect from the kneading plates (51) and the rubbing effect from the two rubbing disks (43) on one side of the massager of the present invention enable the user to enjoy two different massaging effects simultaneously.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the fill extent indicated by the broad general meaning of the terms in which the appended claims are expressed.

What is claimed is:

1. A massager comprising:

a base having a central seat mounted on a central area of the base, two side seats respectively mounted on opposed sides of the central seat and a mediate seat integrally formed on the base and sandwiched between the central seat and the side seat;

a motor assembly having a motor received in the central seat and having a worm shaft extending out of the motor, a linkage mounted across the central seat and provided with a worm gear fixedly mounted around the linkage to mate with the worm shaft and a driving gear fixedly mounted around the linkage;

a transmission assembly including a transmission axle having two ends to be received in the two side seats, a linking gear fixedly mounted around the transmission axle to mate with the driving gear of the motor assembly, two secondary linking gears respectively mounted on the transmission axle and being divided by the central seat and two pairs of wobbling wheels respectively mounted on the transmission axle to be opposite to one another to sandwich therebetween one secondary linking gear and divided by the mediate seat;

two pairs of rubbing assemblies respectively provided to the opposed sides of the central seat and each rubbing assembly including two horizontal gears respectively mated with the secondary linking gear in opposite directions relative to the secondary linking gear, two rubbing disks respectively mounted on top of a corresponding one of the two horizontal gears to be driven by the horizontal gears and having multiple bosses formed on a top face of each rubbing disk;

two pairs of kneading assemblies respectively provided to the opposed sides of the central seat and each kneading assembly having two kneading plates each mounted on a corresponding one of the two wobbling wheels to wobble with the wobbling wheels, wherein the transmission assembly further has two annular sleeves each corresponding to one of the wobbling wheels to be slidably mounted on the transmission axle and two control knobs respectively and threadingly connected to the two ends of the transmission axle to abut a peripheral edge of a corresponding one of the two annular sleeves such that rotation of the control knob is able to control position of the wobbling wheels.

2. The massager as claimed in claim 1, wherein each of the kneading plates has a pair of extensions extending out from a bottom of the kneading plate to define therebetween a path, and a guiding rib is formed on a top face of the base to be received in the path so that movements of the kneading plates are limited by the guiding rib.

3. The massager as claimed in claim 2, wherein each kneading plate is provided with a kneading pad mounted on the kneading plate.

4. The massager as claimed in claim 1, wherein each kneading plate is provided with a kneading pad mounted on the kneading plate.

* * * * *